US011974649B2

(12) United States Patent
Lee et al.

(10) Patent No.: US 11,974,649 B2
(45) Date of Patent: May 7, 2024

(54) COSMETIC CONTAINER

(71) Applicant: SAMHWA CO., LTD, Uiwang-si (KR)

(72) Inventors: Kyung Chang Lee, Uiwang-si (KR); Chang Gon Kim, Hwaseong-si (KR)

(73) Assignee: SAMHWA CO., LTD, Uiwang-si (KR)

( * ) Notice: Subject to any disclaimer, the term of this patent is extended or adjusted under 35 U.S.C. 154(b) by 377 days.

(21) Appl. No.: 17/442,616

(22) PCT Filed: Dec. 6, 2019

(86) PCT No.: PCT/KR2019/017155
§ 371 (c)(1),
(2) Date: Sep. 24, 2021

(87) PCT Pub. No.: WO2020/213805
PCT Pub. Date: Oct. 22, 2020

(65) Prior Publication Data

US 2022/0167725 A1 Jun. 2, 2022

(30) Foreign Application Priority Data

Apr. 15, 2019 (KR) ..... 10-2019-0043676

(51) Int. Cl.
*A45D 40/00* (2006.01)
*A45D 40/26* (2006.01)

(52) U.S. Cl.
CPC ..... *A45D 40/0075* (2013.01); *A45D 40/26* (2013.01); *A45D 2200/055* (2013.01)

(58) Field of Classification Search
CPC ..... A45D 40/00; A45D 40/0068; A45D 40/0075; A45D 40/22; A45D 2200/055;
(Continued)

(56) References Cited

U.S. PATENT DOCUMENTS 9,894,980 B2 * 2/2018 Kim ..... B65D 47/244
2020/0205544 A1 * 7/2020 Kim ..... A45D 33/02
2022/0095767 A1 * 3/2022 Lee ..... A45D 40/10

FOREIGN PATENT DOCUMENTS

KR 10-2013-0102280 A 9/2013
KR 20-2014-0000302 U 1/2014
(Continued)

OTHER PUBLICATIONS

KR101590936B1.Translation (Year: 2016).*
International Search Report in International Application No. PCT/KR2019/017155, dated Mar. 23, 2020, 2pages.

*Primary Examiner* — Cris L. Rodriguez
*Assistant Examiner* — Karim Asqiriba
(74) *Attorney, Agent, or Firm* — Park, Kim & Suh, LLC

(57) ABSTRACT

A cosmetic container is disclosed. A cosmetic container according to one aspect of the present invention comprises: an inner case having an inner space; a rotating bezel which is rotatably coupled to the upper part of the inner case and which has a discharge hole; a rotating member positioned in the inner space, and coupled to the rotating bezel so as to rotate integrally with the rotating bezel; and a piston positioned in the inner space, and coupled to the rotating member so as to be lifted or lowered by being linked with the rotation of the rotating member, wherein contents are discharged through the discharge hole by the lifting of the piston.

5 Claims, 5 Drawing Sheets

(58) Field of Classification Search
CPC ..... A45D 2200/1018; A45D 33/00; A45D 33/003; A45D 33/006; A45D 33/02; A45D 33/025; A45D 33/06; A45D 33/10; A45D 33/14; A45D 33/16; A45D 33/34
USPC ..... 401/172, 174; 222/386, 387, 390, 405
See application file for complete search history.

(56) References Cited

FOREIGN PATENT DOCUMENTS

| | | | | |
|---|---|---|---|---|
| KR | 10-1440010 | B1 | | 11/2014 |
| KR | 10-1590936 | B1 | | 2/2016 |
| KR | 101590936 | B1 | * | 2/2016 |
| KR | 10-2018-0103521 | A | | 9/2018 |

* cited by examiner

COSMETIC CONTAINER

CROSS-REFERENCE TO RELATED APPLICATIONS

This application is a National Phase Application of PCT International Application No. PCT/KR2019/017155, which was filed on Dec. 6, 2019, and which claims priority from Korean Patent Application No. 10-2019-0043676 filed on Apr. 15, 2019. The disclosures of the above patent applications are incorporated herein by reference in their entirety.

BACKGROUND

Technical Field

The present invention relates to a cosmetic container that can dispense a content by way of rotation.

Description of the Related Art

There are various types of cosmetics, which may be divided according to states of matter into liquid types, solid types, and cream or gel types, which can be regarded as intermediate types between liquids and solids. In recent times, cream and gel types have come into wide use according to the purpose of the cosmetics and the cases in which they are held, and gel type cosmetics are widely being used as an alternative to the conventional powder type compact foundation.

A conventional gel type compact foundation may be applied by allowing the content to seep into a sponge and then pressing on the sponge such that the content is applied on a puff. However, with this conventional type of compact foundation based on sponge immersion, the content is always exposed to the outside and in contact with air, so that the content may easily spoil. Also, since the conventional sponge-immersion type compact foundation involves the user pressing on the sponge with a puff, there is difficulty in using up the content completely, and there is a problem of bad hygiene as direct contact between the puff and the sponge allows harmful bacteria to propagate.

SUMMARY OF THE INVENTION

Technical Problem

An aspect of the present invention, which was conceived to resolve the problems described above, is to provide a cosmetic container that allows a discharging of the content in a convenient and hygienic manner.

Other objectives of the present invention will be more clearly understood from the embodiments set forth below.

Solution to Problem

One aspect of the present invention provides a cosmetic container that includes: an inner case having an interior space; a rotary bezel that is rotatably coupled to an upper portion of the inner case and has a dispenser hole formed therein; a rotation member positioned within the interior space and coupled with the rotary bezel to rotate together with the rotary bezel as an integrated body; and a piston positioned within the interior space and coupled with the rotation member to move up or down in cooperation with a rotation of the rotation member, where an upward movement of the piston may cause a content to be discharged through the dispenser hole.

A cosmetic container according to an embodiment of the present invention can include one or more of the following features. For example, the rotary bezel can include a downwardly protruding center protrusion, and the rotation member can include a rotation body and a base, where the rotation body can be configured to receive the center protrusion inserted therein, and the base can be formed on an end portion of the rotation body to be positioned on a bottom surface of the inner case.

The inner case can include an inner periphery member forming the interior space, and the piston can be screw-joined to the rotation body and can include at its edge a peripheral groove and a pressing protrusion, where the pressing protrusion can be configured to press on the inner periphery member elastically by way of the peripheral groove.

The inner case can include an outer periphery member positioned on the outer side of the inner periphery member, the rotary bezel can be rotatably coupled to an upper end of the outer periphery member, and the rotary bezel can include a lower protrusion configured to contact an outer perimeter of the inner periphery member.

The cosmetic container can further include a mixing plate coupled to an upper portion of the rotation member, where the mixing plate can be made from stainless steel.

A lid can be provided at an upper portion of the rotary bezel, a sealing member contacting the rotary bezel can be coupled to a lower portion of the lid, and the sealing member can include a downward pressing protrusion that is configured to downwardly press the mixing plate.

Advantageous Effects of Invention

An embodiment of the present invention can provide a cosmetic container that allows a discharging of the content in a convenient and hygienic manner.

DETAILED DESCRIPTION OF THE INVENTION

Figure 1:
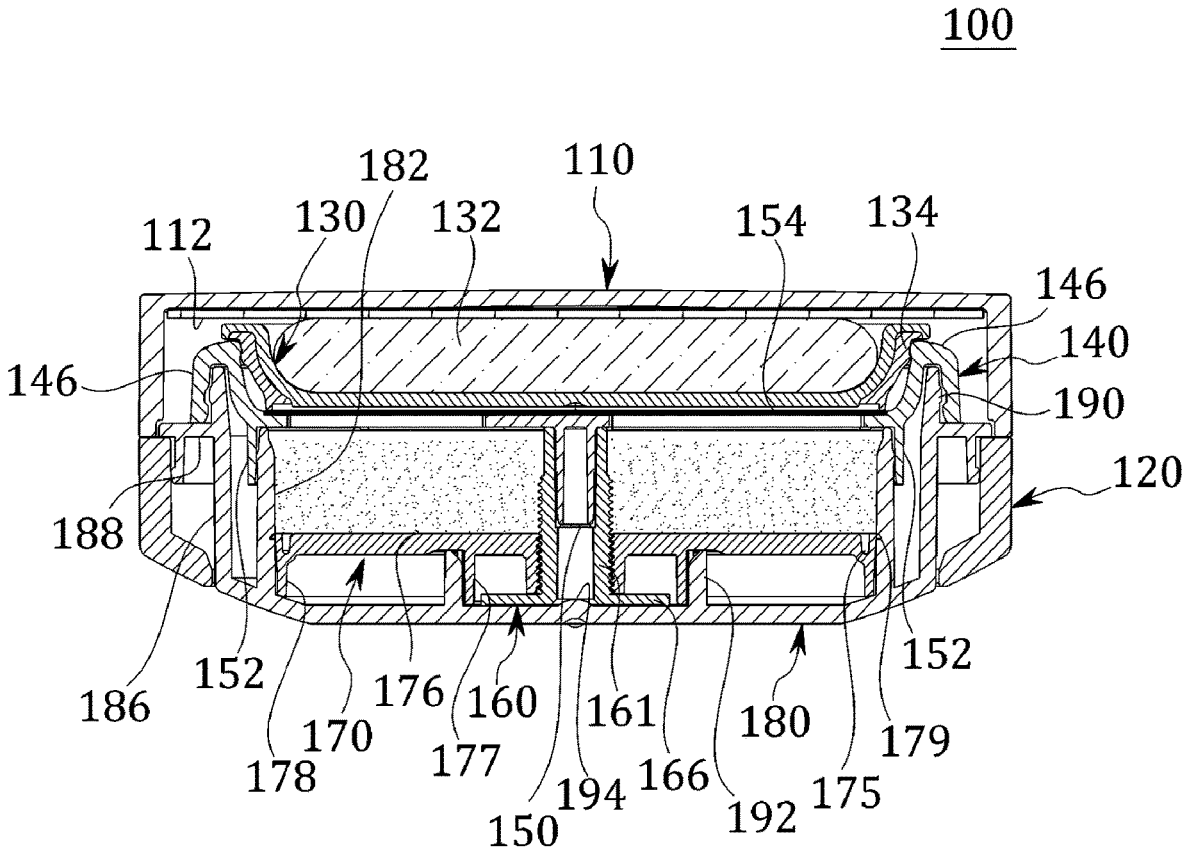
FIG. 1 is a cross-sectional view illustrating a cosmetic container according to a first disclosed embodiment of the present invention.

As the invention allows for various changes and numerous embodiments, particular embodiments will be illustrated in the drawings and described in detail in the written description. However, this is not intended to limit the present invention to particular modes of practice, and it is to be appreciated that all changes, equivalents, and substitutes that do not depart from the spirit and technical scope of the present invention are encompassed by the present invention. In the description of the present invention, certain detailed explanations of the related art are omitted if it is deemed that they may unnecessarily obscure the essence of the invention.

The terms used in the present specification are merely used to describe particular embodiments and are not intended to limit the present invention. An expression used in the singular encompasses the expression of the plural, unless it has a clearly different meaning in the context. In the present specification, it is to be understood that terms such as "including" or "having," etc., are intended to indicate the existence of the features, numbers, steps, actions, components, parts, or combinations thereof disclosed in the specification and are not intended to preclude the possibility that one or more other features, numbers, steps, actions, components, parts, or combinations thereof may exist or may be added.

While such terms as "first" and "second," etc., can be used to describe various components, such components are not to be limited by the above terms. The above terms are used only to distinguish one component from another.

Certain embodiments of the present invention will be described below in more detail with reference to the accompanying drawings. Those components that are the same or are in correspondence are rendered the same reference numeral, and redundant descriptions are omitted.

Figure 2:
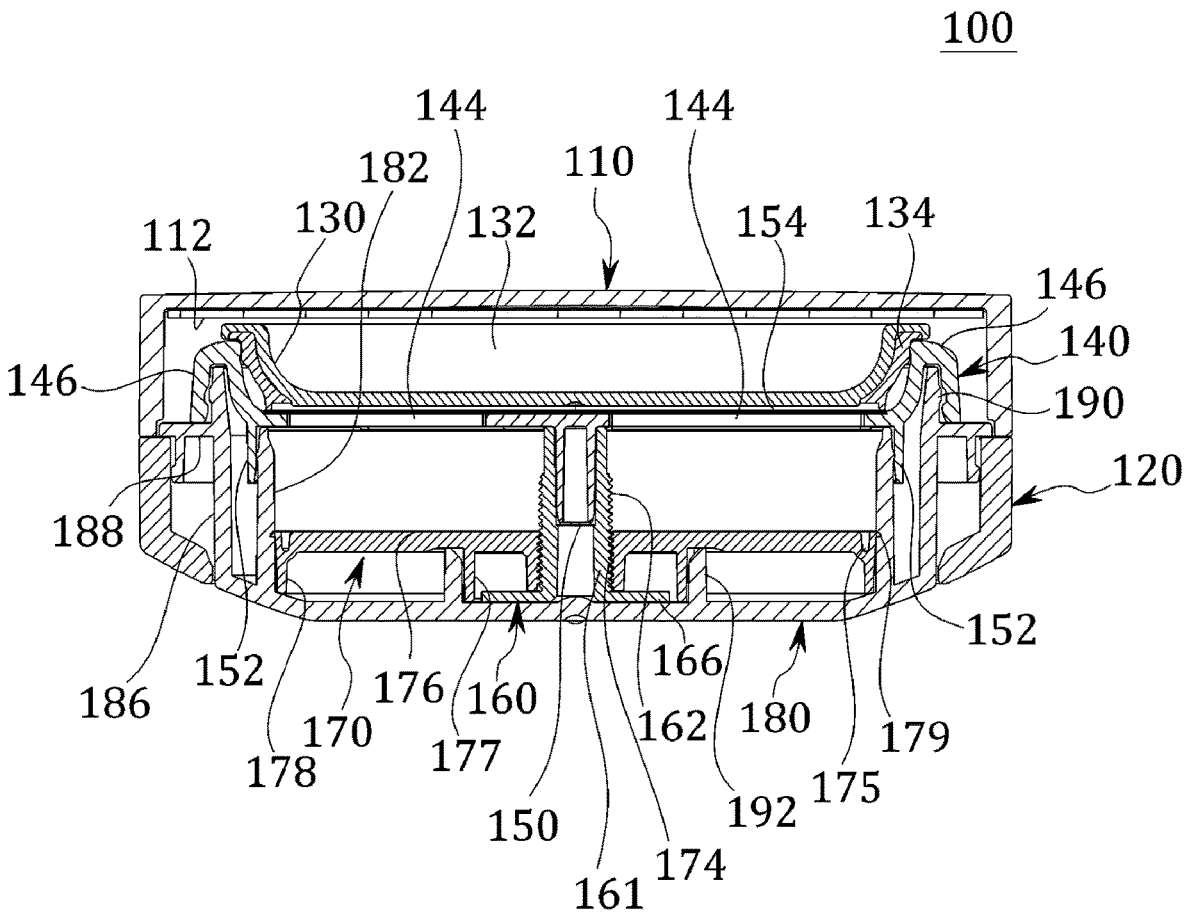
FIG. 2 is a cross-sectional view illustrating the cosmetic container of FIG. 1 with the content removed.
Figure 3:
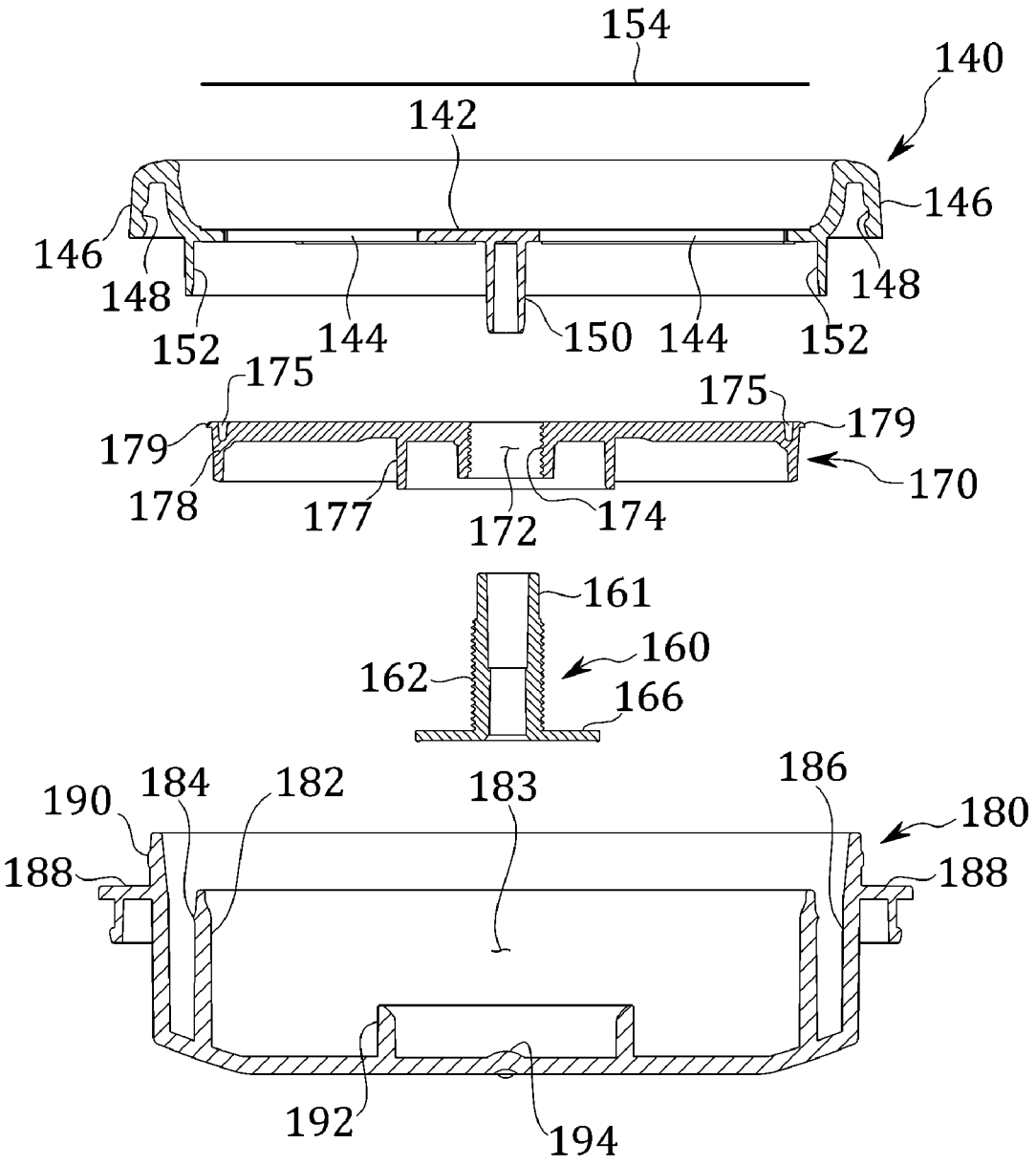
FIG. 3 is a cross-sectional view illustrating the cosmetic container of FIG. 1 in a partially disassembled form.
Figure 4:
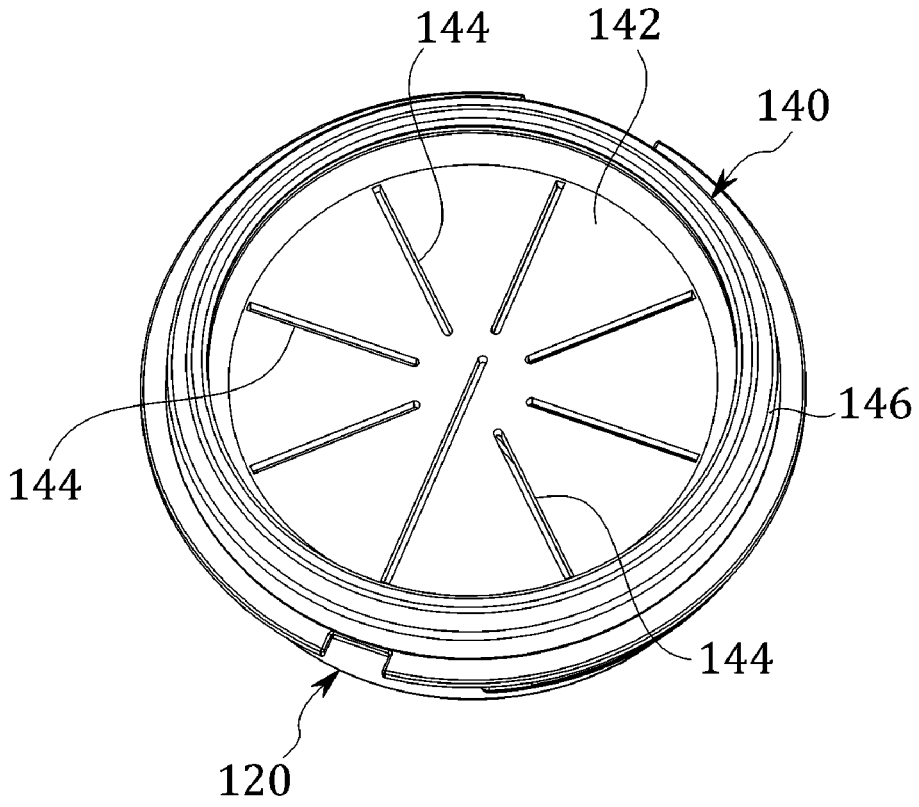
FIG. 4 is a top view illustrating the rotary bezel of the cosmetic container of FIG. 1.
Figure 5:
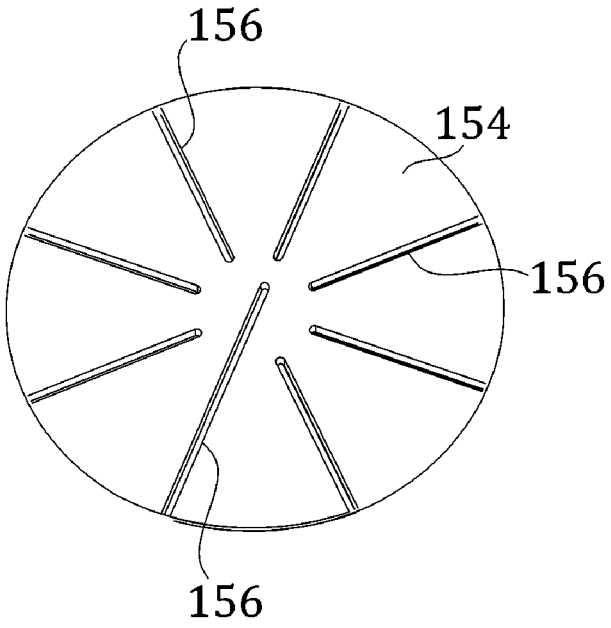
FIG. 5 is a diagram illustrating the mixing plate of the cosmetic container of FIG. 1.

FIG. 1 is a cross-sectional view illustrating a cosmetic container 100 according to a first disclosed embodiment of the present invention, and FIG. 2 is a cross-sectional view illustrating the cosmetic container 100 of FIG. 1 with the content 200 removed. Also, FIG. 3 is a cross-sectional view illustrating the cosmetic container 100 in a partially disassembled form, and FIG. 4 is a top view illustrating the rotary bezel 140 of the cosmetic container 100. FIG. 5 is a diagram illustrating the mixing plate 154.

Incidentally, FIG. 4 provides an illustration in which the mixing plate 154, lid 130, and upper case 110 have been removed from the upper portion of the rotary bezel 140.

Referring to FIGS. 1 to 5, a cosmetic container 100 according to this embodiment may involve a rotation of the rotary bezel 140 causing the piston 170 to move upward, which in turn may cause the content 200 to be dispensed through the dispenser holes 144 of the rotary bezel 140. That is, the piston 170 may move upward in cooperation with the rotation of the rotary bezel 140 and may press the content in the direction of the dispenser holes 144 such that the content is discharged. A mixing plate 154 can additionally be provided over the dispenser holes 144. Thus, with a cosmetic container 100 based on this embodiment, the content 200 may not be open towards and exposed to the outside but rather may be separated by a top plate 142 or a mixing plate 154, thus maintaining a high level of hygiene.

A cosmetic container 100 based on this embodiment may include an inner case 180, a rotary bezel 140, a rotation member 160, and a piston 170. Also, a cosmetic container 100 based on this embodiment may include an upper case 110 and a lower case 120 that form the exterior, as well as a lid 130 positioned over the rotary bezel 140.

The inner case 180 may be inserted in the center of the lower case 120 and may form the part where the content 200 is filled in. The inner case 180 may include an inner periphery member 182, an outer periphery member 186, and a center periphery member 192.

The outer periphery member 186 may be the part forming the overall diameter of the inner case 180 and may have a particular height and diameter. The inner periphery member 182 may be positioned on an inner side of the outer periphery member 186. The height of the outer periphery member 186 may be formed greater than the height of the inner periphery member 182.

On the outer perimeter of the outer periphery member 186, there may be formed a flange 188 that protrudes outward perpendicularly. The lower end of a coupling member 146 of the rotary bezel 140 can be positioned on the upper surface of the flange 188. Also, on the lower surface of the flange 188, a protrusion (no numeral assigned) may be formed for coupling with the lower case 120.

The rotary bezel 140 may be rotatably coupled to the upper end of the outer periphery member 186. That is, a C-shaped coupling member 146 may be provided along the edge of the rotary bezel 140, and the coupling member 146 may be rotatably inserted onto the upper end of the outer periphery member 186. Also, a detent protrusion 190 may be formed on the outer perimeter of the outer periphery member 186. The detent protrusion 190 may be inserted into a detent groove 148 formed in the inner perimeter of the coupling member 146, thereby preventing the rotary bezel 140 from becoming detached from the inner case 180.

A particular gap may be formed between the outer periphery member 186 and the inner periphery member 182.

The inner periphery member 182 may be positioned at an inner side of the outer periphery member 186 and may be concentric with the outer periphery member 186. The rotation member 160 and the piston 170 may be positioned within the interior space 183 formed by the inner periphery member 182. Within the interior space 183, a space for filling the content 200 may be formed over the piston top plate 176 of the piston 170.

A sealing protrusion 184 may be formed on the outer perimeter of the inner periphery member 182. The sealing protrusion 184 may press against the inner perimeter of a lower protrusion 152 of the rotary bezel 140 so as to prevent any leaking of the content 200.

The rotation member 160 and the piston 170 may be positioned on the bottom surface of the inner case 180 on the inner side of the inner periphery member 182.

In the center in the inside of the inner case 180, there may be formed a center periphery member 192. The center periphery member 192 may have a lower height than that of the inner periphery member 182. The rotation member 160 may be positioned on the inner side of the center periphery member 192. Also, the inner perimeter of the center periphery member 192 may contact the outer perimeter of a guide member 177 of the piston 170. This may prevent looseness of the piston 170 and allow stable upward and downward movements. The upper end of the center periphery member 192 can contact a lower surface of the piston 170.

On the inner side of the center periphery member 192, a center protrusion 194 may be formed protruding from the bottom surface. The center protrusion 194 may be inserted within the rotation body 161 of the rotation member 160 to set the proper position of the rotation body 161 and prevent looseness.

The rotary bezel 140 may be rotatably coupled to the inner case 180 and may couple with the rotation member 160 to rotate together with the rotation member 160 as an integrated body. The rotary bezel 140 may include a top plate 142, which may be positioned under the lid 130 and in which the dispenser holes 144 for dispensing the content may be formed.

A C-shaped coupling member 146 may be formed on the edge of the rotary bezel 140. The coupling member 146 may be formed protruding upwardly from the end portions of the top plate 142, whereby the rotary bezel 140 may have a generally concave shape. The end portion of the outer periphery member 186 may be inserted into the coupling member 146. Also, the detent groove 148 may be formed in the inner perimeter of the coupling member 146, and the detent protrusion 190 of the outer periphery member 186 may be inserted into the detent groove 148 as described above.

The rotary bezel 140 may include a circular top plate 142. The top plate 142 may form a flat surface and may correspond to the plane where the content 200 is dispensed. A multiple number of dispenser holes 144 may be formed in the top plate 142. The dispenser holes 144 may correspond to channels through which the content 200 can be discharged to the outside.

A mixing plate 154 can additionally be positioned on an upper portion of the rotary bezel 140. The mixing plate 154 can be a thin circular stainless steel plate and include a multiple number of dispenser holes 156. The dispenser holes 156 formed in the mixing plate 154 can connect with the dispenser holes 144 formed in the top plate 142. Also, the two sets of dispenser holes 144, 156 can have the same sizes and positions and can be disposed in aligned positions or, so as to allow a readier mixing of the content, in misaligned positions.

Along the edge on the lower surface of the rotary bezel 140, there may be formed a lower protrusion 152 protruding vertically downward. The inner perimeter of the lower protrusion 152 can contact the outer perimeter of the inner periphery member 182, thus preventing any leakage of the content.

In the center on the lower surface of the rotary bezel 140, there may be formed a center protrusion 150 protruding vertically downward. The center protrusion 150 may be pressed into the inside of the rotation body 161 of the rotation member 160, whereby the rotary bezel 140 and the rotation member 160 may rotate together as an integrated body.

The rotation member 160 may be coupled to and rotate together with the rotary bezel 140 and thereby enable the upward and downward movement of the piston 170. The rotation member 160 may only rotate and may not move up or down itself. Also, the rotation member 160 may include a rotation body 161, which may have the shape of a hollow cylinder, and a base 166, which may be provided on the lower end of the rotation body 161 and may have the shape of a circular disc.

A thread 162 may be formed on the outer perimeter of the rotation body 161. The thread 162 may form a screw joint with a thread 174 formed in the inner perimeter of the center hole 172 of the piston 170. This can enable the piston 170 to move up and down in cooperation with the rotation of the rotation member 160. Also, the upper end of the rotation body 161 can receive the center protrusion 150 of the rotary bezel 140 inserted therein, and the lower end of the rotation body 161 can receive the center protrusion 194 of the inner case 180 inserted therein.

The base 166 may be positioned on the bottom surface of the inner case 180 and may allow the rotation member 160 to rotate in a stable manner.

The piston 170 may move up and down in cooperation with the rotation of the rotation member 160 and may serve to push the content 200 in the direction of the dispenser holes 144. The piston 170 may include a circularly shaped piston top plate 176, a center hole 172, and a piston periphery member 178.

The piston top plate 176 may correspond to a lower surface of the interior space 183 into which the content 200 is injected and may be formed in a circular shape. A peripheral groove 175 of a particular depth may be formed in the edge of the piston top plate 176. Because of the peripheral groove 175, a pressing protrusion 179 may be formed at the end portion along the edge of the piston top plate 176. The pressing protrusion 179 may correspond to an elastic piece that elastically presses against the inner perimeter of the inner periphery member 182. The pressing protrusion 179 formed in this manner can prevent the content 200 from leaking out of the interior space 183.

In the center of the piston top plate 176, there may be formed a center hole 172. The center hole 172 may have a particular depth, and a thread 174 may be formed in the inner perimeter of the center hole 172. The thread 174 formed in the center hole 172 may be screw-joined with the thread 162 of the rotation member 160 as already described above.

Around the center hole 172 on the lower surface of the piston 170, there may be formed a guide member 177 protruding vertically downward. The outer perimeter of the guide member 177 may contact the inner perimeter of the center periphery member 192 of the inner case 180.

The piston top plate 176 may include, along its edge, a piston periphery member 178 that protrudes vertically downward. The piston periphery member 178 may have a particular length, where the length can be the same or almost the same as that of the guide member 177. The outer perimeter of the piston periphery member 178 can maintain a surface contact with the inner perimeter of the inner periphery member 182. Also, the pressing protrusion 179 may be formed protruding outwardly from the upper end of the piston periphery member 178. Such structure of the piston periphery member 178 and the pressing protrusion 179 can prevent leakage of the content 200 that is injected into the interior space 183.

The lid 130 may be positioned on the inner side of the rotary bezel 140. The lid 130 may correspond to an inner cover of the cosmetic container 100 and may have a particular interior space. A puff 132 can be positioned in the interior space of the lid 130. A sealing member 134 can be coupled to a lower portion of the lid 130. The sealing member 134 can be placed in tight contact with the upper end of the rotary bezel 140 to prevent any leakage of the content. The sealing member 134 can be made from a flexible material such as silicone, elastic rubber, etc.

At a lower end of the sealing member 134, there may be formed a downward pressing protrusion 136. The downward pressing protrusion 136 can downwardly press the mixing plate 154 or the top plate 142 of the rotary bezel 140 located underneath.

The upper case 110 and the lower case 120 may be coupled to each other to form the exterior of the cosmetic container. The inner case 180 may be inserted into the center of the inside of the lower case 120. Also, a hinge (not shown) for enabling a rotation of the lid 130 can be coupled to the lower case 120.

The upper case 110 may be coupled to be rotatable with respect to the lower case 120. A mirror 112 can be provided on the inner surface of the upper case 110.

Thus, a cosmetic container 100 based on this embodiment allows convenient use, as rotating the rotary bezel 140 causes the piston 170 to move upward, which in turn causes the content to be dispensed onto the upper surface of the mixing plate 154. In particular, since the content 200 or an object (such as a porous sponge, etc.) holding the content is pushed by the piston 170 uniformly against a planar surface, it is possible to completely use up the content without leaving any remaining. Also, since there is no direct contact between the puff 132 and the content 200 and only the content 200 that has been dispensed onto the mixing plate 154 comes into contact with the puff 132, the problem of the content 200 being contaminated by the puff can also be resolved.

A cosmetic container 100 based on this embodiment provides the advantage that the content 200 can be dispensed in constant amounts, since the piston 170 moves upward in proportion to the rotation of the rotary bezel 140 and the content is dispensed correspondingly. A cosmetic container 100 according to this embodiment also provides the advantage of a simple composition formed by the rotary bezel 140, rotation member 160, and piston 170.

While the foregoing provides a description with reference to an embodiment of the present invention, it should be appreciated that a person having ordinary skill in the relevant field of art would be able to make various modifications and alterations to the present invention without departing from the spirit and scope of the present invention set forth in the scope of claims below.

What is claimed is:

1. A cosmetic container comprising:

an inner case having an interior space;

a rotary bezel rotatably coupled to an upper portion of the inner case and having a dispenser hole formed therein;

a rotation member positioned within the interior space and securely coupled with the rotary bezel to rotate together with the rotary bezel as an integrated body; and a piston positioned within the interior space and thread-coupled with the rotation member to move up or down in cooperation with a rotation of the rotation member wherein the piston is not rotated when the rotary bezel is rotated, wherein an upward movement of the piston causes a content to be discharged through the dispenser hole, wherein the rotary bezel comprises a downwardly protruding center protrusion, wherein the rotation member comprises a rotation body and a base, the rotation body being securely coupled to the center protrusion, the base being formed on an end portion of the rotation body and positioned on a bottom surface of the inner case, wherein the rotation body and the base are rotated when the rotary bezel is rotated, wherein the piston has a center hole which is thread-coupled to an outer surface of the rotation body such that the piston vertically moves when the rotation body is rotated.

2. The cosmetic container of claim 1, wherein the inner case comprises an inner periphery member forming the interior space, and the piston is screw-joined to the rotation body and comprises a peripheral groove and a pressing protrusion at an edge thereof, the pressing protrusion configured to press on the inner periphery member elastically by way of the peripheral groove.

3. The cosmetic container of claim 2, wherein the inner case comprises an outer periphery member positioned on an outer side of the inner periphery member, the rotary bezel is rotatably coupled to an upper end of the outer periphery member, and the rotary bezel comprises a lower protrusion configured to contact an outer perimeter of the inner periphery member.

4. The cosmetic container of claim 1, further comprising a mixing plate coupled to an upper portion of the rotation member, wherein the mixing plate is made from stainless steel.

5. The cosmetic container of claim 4, wherein a lid is provided at an upper portion of the rotary bezel, a sealing member contacting the rotary bezel is coupled to a lower portion of the lid, and the sealing member comprises a downward pressing protrusion configured to downwardly press the mixing plate.

* * * * *